US007240652B2

(12) United States Patent
Roerig et al.

(10) Patent No.: US 7,240,652 B2
(45) Date of Patent: Jul. 10, 2007

(54) SWITCHABLE DRAG LEVER OF A VALVE TIMING MECHANISM OF AN INTERNAL COMBUSTION ENGINE

(75) Inventors: Bodo Roerig, Weisendorf (DE); Stefan Gemein, Fürth (DE); Nicola Morelli, Fürth (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/499,563

(22) Filed: Aug. 4, 2006

(65) Prior Publication Data

US 2007/0000460 A1 Jan. 4, 2007

(30) Foreign Application Priority Data

Aug. 5, 2005 (DE) ..... 10 2005 037 052

(51) Int. Cl.
*F01L 1/18* (2006.01)

(52) U.S. Cl. ..... 123/90.39; 123/90.41; 123/90.43; 123/90.16

(58) Field of Classification Search ..... 123/90.43, 123/90.39, 90.16, 90.15, 90.41
See application file for complete search history.

(56) References Cited

U.S. PATENT DOCUMENTS 6,532,920 B1 3/2003 Sweetnam et al.
6,769,387 B2 * 8/2004 Hayman et al. ..... 123/90.39

FOREIGN PATENT DOCUMENTS

DE 102 57 705 A1 6/2004
DE 10 2004 007 766 A1 9/2004
DE 103 10 226 A1 9/2004
DE 103 10 968 A1 9/2004
EP 1 367 228 A1 12/2003

* cited by examiner

*Primary Examiner*—Thomas Denion
*Assistant Examiner*—Zelalem Eshete
(74) *Attorney, Agent, or Firm*—Charles A. Muserlian

(57) ABSTRACT

A switchable drag lever (1) of a valve timing mechanism of an internal combustion engine is proposed, having an outer lever (3) and an inner lever (4) which is arranged between the said outer lever (3). The drag lever (1) has a rest (7) for a gas exchange valve on an underside (5) at one end (6), and a pivoting bearing (9) for a supporting element on an underside (5) at the other end (8). The levers (3, 4) extend at one end (6) on a common pin (10). Receptacles (10*a*, 10*b*) for coupling means are provided which extend longitudinally at the end (8) facing away from the pin (10) and are aligned with respect to one another in the cam base circle. The side walls (2) of the outer lever (3) have contact faces (12) for lifting cams on their upper sides (11). A segment-like collar (13) protrudes inwards from each upper side (11), which segment-like collar (13) forms a structural unit with the respective contact face (12), the corresponding underside (14) of the collar (13) bearing against a complementary stop face (15) of an upper side (16) of the adjacent arm (2*a*) of the inner lever (4) in the coupling case. Alignment of the receptacles (10*a*, 10*b*) is therefore provided in a simple way for the coupling case.

12 Claims, 1 Drawing Sheet

SWITCHABLE DRAG LEVER OF A VALVE TIMING MECHANISM OF AN INTERNAL COMBUSTION ENGINE

FIELD OF THE INVENTION

The invention relates to a switchable drag lever of a valve timing mechanism of an internal combustion engine, having an outer lever and an inner lever which is arranged with its arms between the side walls of the said outer lever, a rest for a gas exchange valve being intrinsic to the drag lever on an underside at one end, and a pivoting bearing being intrinsic to the drag lever on an underside at the other end, the levers extending at one of the ends on a common pin and having receptacles for at least one coupling means which extend longitudinally at the end facing away from the pin and are aligned with respect to one another in the cam base circle, which coupling means can be displaced for coupling the levers in sections in or below the receptacle which lies opposite, and the side walls of the outer lever being provided on their upper sides with contact faces for lifting cams.

BACKGROUND OF THE INVENTION

In order to produce an aligned position of receptacles for coupling means in the cam base circle in levers which are already known from the prior art, the respective outer lever has a stop which engages in the manner of a bracket under the corresponding inner lever approximately in the region of a transverse centre plane.

On account of the necessary transition radii of this bracket-like stop from the arms of the outer lever, as viewed in the transverse direction, a drag lever of this type has to be of relatively wide construction, as the inner lever cannot come into contact with an upper side of the transverse bracket in the radius region. If, nevertheless, there is contact in the region of the radii, unnecessarily high material loading is to be expected. States can also occur, in which there is not sufficient alignment of the coupling means with respect to the receptacle which lies opposite, with the result that coupling cannot be realized.

Secondly, it is obvious that, on account of the transverse bracket which engages over the underside of the inner lever, the drag lever is of unnecessarily deep construction. Here, problems can occur with freedom of movement in the region of the cylinder head.

OBJECT OF THE INVENTION

It is therefore an object of the invention to provide a drag lever of the abovementioned generic type, in which the disadvantages described are eliminated.

ACHIEVEMENT OF THE OBJECT

According to the invention, this object is achieved in that a segment-like collar protrudes inwards from the upper side of each side wall of the outer lever, the underside of the said segment-like collar bearing against a complementary stop face of an upper side of the adjacent arm of the inner lever in the coupling case.

The above-described disadvantages are therefore eliminated. The scope of protection of this invention also relates to solutions for switchable drag levers, in which what is known as "transverse locking" is applied. On account of the internal stop measures on undersides of the collars, which collars are preferably configured in one piece with the contact faces for low-lift cams, the abovementioned bracket-like stop which engages under the inner lever can be omitted.

In addition, according to a further refinement of the invention, the collar with the contact faces is to be configured in one piece with the side walls of the outer lever. The collar with the sliding faces can also expediently extend in an aligned manner with respect to upper sides of the side walls.

As a result of the measures according to the invention, simple alignment of the receptacles is provided for the coupling means in the cam base circle. At the same time, freedom of movement of the mating running face of the inner lever can be realized in the cam base circle in relation to its cam, via the stop measures. As an alternative, freedom of movement of the mating running faces of the outer lever can also be realized. As a result of the last-mentioned measures, structural redundancy is avoided and, at the same time, base circle friction is reduced.

The measures according to the invention make it possible to provide a drag lever which is of relatively narrow construction, as its contact faces are displaced further in the direction of a longitudinal centre plane of the drag lever. If an identical lever width is used, there are greater widths of the contact faces, which has a positive effect on the Hertzian stress.

According to one expedient development of the invention, there is provision for the undersides of the collars to be in contact over their entire length with the stop faces of the upper sides of the arms of the inner lever in the coupling case. This therefore results in a stable and low-wear stop.

Simple measures for supporting the contact faces which protrude outwardly beyond the side walls are the subject matter of a further subclaim. According to the latter, finger-like carriers emerge from the end-side ends of the said contact faces in the direction of the underside, which finger-like carriers are connected to the corresponding side wall, preferably in one piece.

A drag lever which is optimized with regard to mass and the mass moment of inertia results if it is manufactured at least partially from a lightweight material such as sheet metal. Further lightweight materials such as plastics, composite materials etc. are also suitable here.

Expediently, the rest for the gas exchange valve and the pivoting bearing should be arranged on the outer lever, the pin extending on the side of the rest. The longitudinally extending receptacles for the at least one coupling means can then be applied above the pivoting bearing.

The proposed at least one swivel pin spring as lost-motion spring between the lever components advantageously takes up only a small amount of installation space.

BRIEF DESCRIPTION OF THE DRAWINGS

The invention is expediently explained in greater detail using the drawing, in which.

DETAILED DESCRIPTION OF THE DRAWINGS

Figure 1:
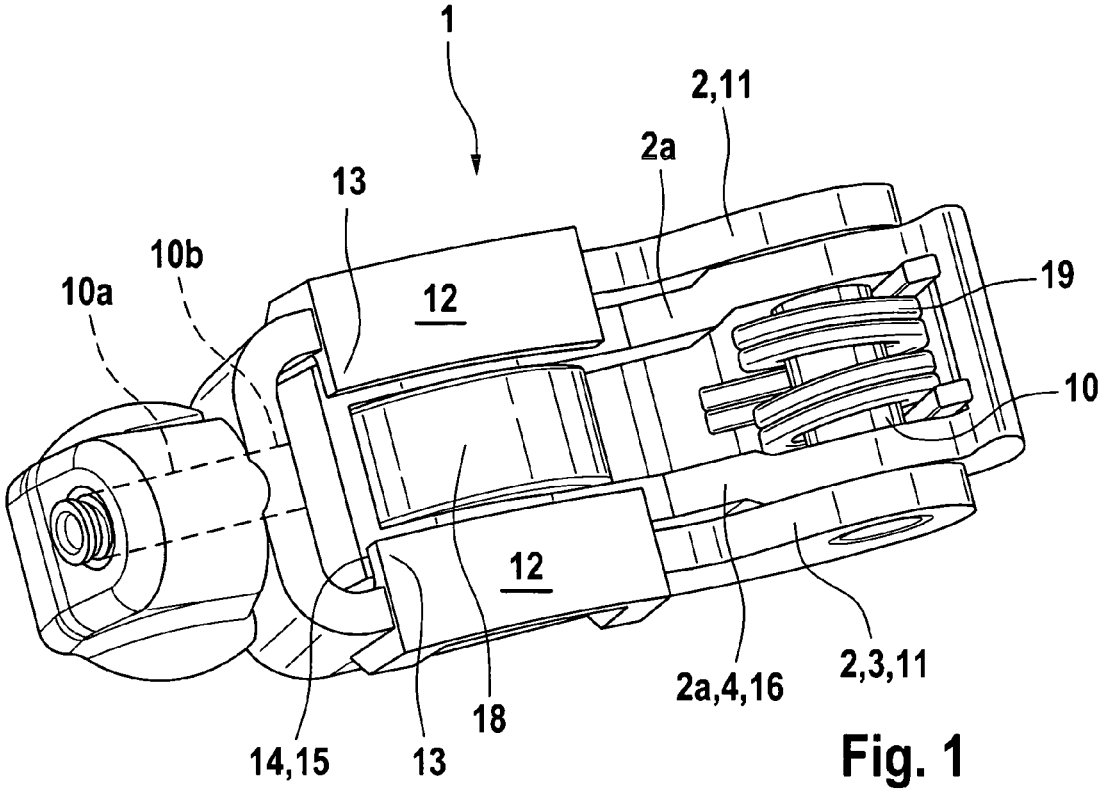
FIG. 1 shows the drag lever according to the invention in a three-dimensional plan view.

The figures disclose a switchable drag lever 1 for a valve timing mechanism of an internal combustion engine. The said drag lever 1 has an outer lever 3. An inner lever 4 is mounted between side walls 2 of the outer lever 3. The said inner lever 4 has two arms 2*a* which are spaced apart and between which a roller runs as a mating running face 18 for a large-lift cam. At one end 8 on an underside 5, the outer lever 3 has a pivoting bearing 9 which is configured as a spherical cap. Via the said pivoting bearing 9, the said outer lever 3 can be mounted in a pivotably movable manner on a head of a supporting element which is, for example, hydraulic. At the other end 6, the outer lever 3 has a rest 7 on the underside 5 for preferably a gas exchange valve.

Furthermore, it is indicated in the drawing that the drag lever 1 has longitudinally extending receptacles 10*a* (outer lever 3), 10*b* (inner lever 4) above the pivoting bearing 9 for a coupling means which is not disclosed in the drawing and is, for example, piston-like. At the other end 6, a pin 10 is arranged, on which the levers 3, 4 run such that they are pivotably movable relative to one another.

As, in particular, FIG. 1 discloses, a swivel pin spring is applied, as a lost-motion spring 19, within the arms 2*a* of the inner lever 4 on the pin 10. The said swivel pin spring guarantees that the inner lever 4 returns in its uncoupled mode to its associated large-lift cams.

It is also shown that a segment-like or vane-like collar 13 protrudes inwardly at an upper side 11 of each side wall 2 of the outer lever 3. Each collar 13 has an underside 14. In the coupling case, the latter is in contact with a complementary stop face 15 of an upper side 16 of the adjacent arm 2*a* of the inner lever 4. This contact is preferably configured in such a way that the complete length of the underside 14 bears against the upper side 16.

The segment-like collars 13 are configured in one piece with contact faces 12 as mating running faces for low-lift cams. The units 12, 13 are preferably intended to extend in one piece with the side walls 2 of the outer lever 3.

Figure 2:
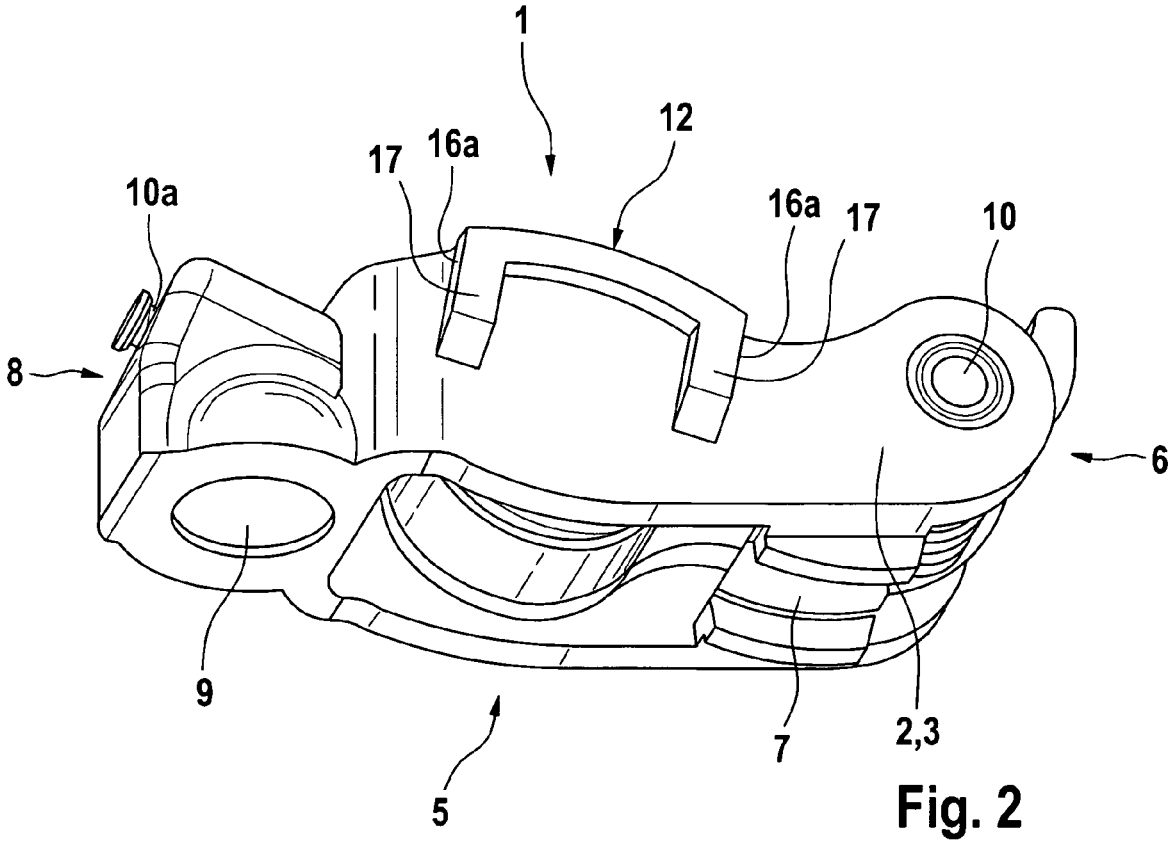
FIG. 2 shows the drag lever according to FIG. 1 in a three-dimensional bottom view.

As FIG. 2 discloses in greater detail, the contact faces 12 are configured in such a way that they protrude outwardly beyond the side walls 2 of the outer lever 3. From the end-side ends 16*a* of the said side walls 2, thin-walled carriers 17 extend in the direction of the underside 5. The latter are connected fixedly to the side walls 2. The contact faces 12 are therefore supported in a highly satisfactory manner with respect to the side walls 2 of the outer lever 3.

On account of the abovementioned refinement, there is a simply designed internal stop of the inner lever 4 with respect to the outer lever 3, for producing alignment of the receptacles 10*a*, 10*b* for the at least one coupling means. Moreover, the mating running face 18 which is preferably configured as a rotatable roller in the inner lever 4 can therefore be held in the cam base circle without contact with the associated large-lift cam.

A sliding face can also optionally be applied as a mating running face 18 instead of the abovementioned roller. It is also conceivable and provided, as long as there is, for example, sufficient installation space laterally, also to provide rollers here as contact face 12 instead of the sliding faces. It is also optionally possible for only one sliding face to be applied as contact face 12, the corresponding face which lies opposite then being without contact.

| List of Reference Numerals | |
|---|---|
| 1) | Drag lever |
| 2) | Side wall |
| 2a) | Arm |
| 3) | Outer lever |
| 4) | Inner lever |

-continued

| List of Reference Numerals | |
|---|---|
| 5) | Underside |
| 6) | End |
| 7) | Rest |
| 8) | End |
| 9) | Pivoting bearing |
| 10) | Pin |
| 10a) | Receptacle |
| 10b) | Receptacle |
| 11) | Upper side |
| 12) | Contact face |
| 13) | Collar |
| 14) | Underside |
| 15) | Stop face |
| 16) | Upper side |
| 16a) | End |
| 17) | Carrier |
| 18) | Mating running face |
| 19) | Lost-motion spring |

The invention claimed is:

1. Switchable drag lever (1) of a valve timing mechanism of an internal combustion engine, having an outer lever (3) and an inner lever (4) which is arranged with its arms (2*a*) between the side walls (2) of the said outer lever (3), a rest (7) for a gas exchange valve being intrinsic to the drag lever (1) on an underside (5) at one end (6), and a pivoting bearing (9) being intrinsic to the drag lever (1) on an underside (5) at the other end (8), the levers (3, 4) extending at one of the ends (6, 8) on a common pin (10) and having receptacles (10*a*, 10*b*) for at least one coupling means which extend longitudinally at the end facing away from the pin (10) and are aligned with respect to one another in the cam base circle, which coupling means can be displaced for coupling the levers (3, 4) in sections in or below the receptacle (10*b*, 10*a*) which lies opposite, and the side walls (2) of the outer lever (3) being provided on their upper sides (11) with contact faces (12) for lifting cams, characterized in that a segment-like collar (13) protrudes inwards from the upper side (11) of each side wall (2) of the outer lever (3), the underside (14) of the said segment-like collar (13) bearing against a complementary stop face (15) of an upper side (16) of the adjacent arm (2*a*) of the inner lever (4) in the coupling case.

2. Drag lever according to claim 1, characterized in that sliding faces are provided on the upper sides (11) of the side walls (2) as contact faces (12) for the lifting cams.

3. Drag lever according to claim 2, characterized in that the contact faces (12) protrude outwardly beyond the side walls (2) of the outer lever (3), in each case one fingerlike carrier (17) running in one piece in the direction of the underside (5) from the end-side ends (16*a*) of the said contact faces (12) in the protruding region, which finger-like carrier (17) is connected to the corresponding side wall (2).

4. Drag lever according to claim 2, characterized in that the contact faces (12) are present as one unit with the segment-like collars (13).

5. Drag lever according to claim 4, characterized in that the unit (12, 13) is configured in one piece with the side walls (2).

6. Drag lever according to claim 4, characterized in that the unit (12, 13) extends flush with respect to the upper side (11) of the corresponding side wall (2).

7. Drag lever according to claim 1, characterized in that, in the coupling case, the undersides (14) of the collars (13) of the outer lever (3) are in contact, over a large part of their length or completely, with the respective stop faces (15) of the upper sides (16) of the arms (2*a*) of the inner lever (4).

8. Drag lever according to claim 1, characterized in that a roller is accommodated as a mating running face (18) for a lifting cam between the arms (2*a*) of the inner lever (4), the said mating running face (18) being designed for following a large stroke and the contact faces (12) of the outer lever (3) being designed for following a stroke which is smaller in comparison or a zero stroke.

9. Drag lever according to claim 8, characterized in that, in the event of contact with the cam base circle, either the mating running face (18) of the inner lever (4) or the contact faces (12) of the outer lever (3) are without contact.

10. Drag lever according to claim 1, characterized in that at least one of the levers (3, 4) is composed of a lightweight material such as sheet metal.

11. Drag lever according to claim 1, characterized in that the rest (7) for the gas exchange valve and the pivoting bearing (9) are arranged on the outer lever (3), the pin (10) extending on the side of the rest (7).

12. Drag lever according to claim 5, characterized in that, between the arms (2*a*) of the inner lever (4), the pin (10) is surrounded by at least one swivel pin spring which acts between the levers (3, 4), as a lost-motion spring (19).

* * * * *